United States Patent [19]

Lemmer

[11] Patent Number: 4,540,859

[45] Date of Patent: Sep. 10, 1985

[54] CONVERTIBLE NORMALLY CLOSED/NORMALLY OPEN SWITCH WITH CAM ACTUATOR

[75] Inventor: Helmut Lemmer, Marienheide, Fed. Rep. of Germany

[73] Assignee: Starkstrom Gummersbach GmbH, Marienheide, Fed. Rep. of Germany

[21] Appl. No.: 644,778

[22] Filed: Aug. 27, 1984

Related U.S. Application Data

[62] Division of Ser. No. 515,020, Jul. 18, 1983.

[30] Foreign Application Priority Data

Jul. 16, 1982 [EP] 07161982 ..... 82106410.2

[51] Int. Cl.[3] ..... H01H 9/00; H01H 15/00

[52] U.S. Cl. ..... 200/6 B; 200/16 A; 200/153 LA; 200/280

[58] Field of Search ..... 200/1 R, 6 R, 6 B, 6 BA, 200/6 BB, 11 R, 14, 16 A, 30 R, 30 A, 31 R, 31 A, 19 A, 153 L, 153 LA, 153 LB, 243, 280

[56] References Cited

U.S. PATENT DOCUMENTS

| | | | |
|---|---|---|---|
| 2,874,252 | 2/1959 | Wenzel et al. | 200/280 |
| 2,991,343 | 7/1961 | Norden | 200/159 R X |
| 3,192,329 | 6/1965 | Murrle' | 200/6 B |
| 3,201,555 | 8/1965 | Lacan et al. | 200/280 X |
| 3,251,956 | 5/1966 | Rasor et al. | 200/14 |
| 3,912,894 | 10/1975 | Mullen et al. | 200/280 X |
| 4,117,429 | 9/1978 | Streich et al. | 335/197 X |
| 4,204,098 | 5/1980 | Strande | 200/1 R |

FOREIGN PATENT DOCUMENTS

| | | |
|---|---|---|
| 1951330 | 4/1971 | Fed. Rep. of Germany . |
| 1089957 | 11/1967 | United Kingdom . |

*Primary Examiner*—J. R. Scott

*Attorney, Agent, or Firm*—Michael J. Striker

[57] ABSTRACT

Disclosed is an electric switching device of the type having a contact system including two stationary contact bars and movable contact bridges for interconnecting the bars. To convert the switching device from a circuit maker to a circuit breaker, or vice versa, there is provided a control member in the form of a shiftable slide having insulating projections which in one end position of the slide are displaced between one bridge and a contact bar while the other projection is out of the range of movement of the bridges, and in the other end position the other insulating projection interrupts the contact between the other bridge and the assigned contact bar. In a modification, the converting member is in the form of a swingable arm cooperating with a slidably supported cam track which is turnable by 180°.

6 Claims, 28 Drawing Figures

FIG.7
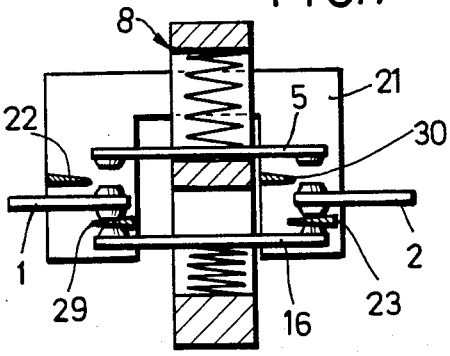
FIG.8
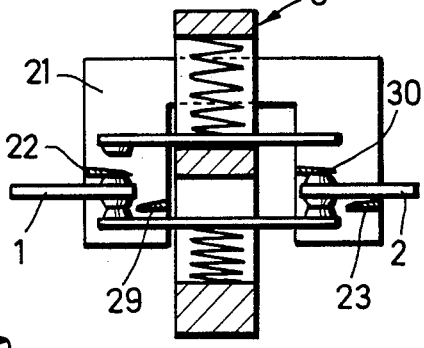
FIG.9
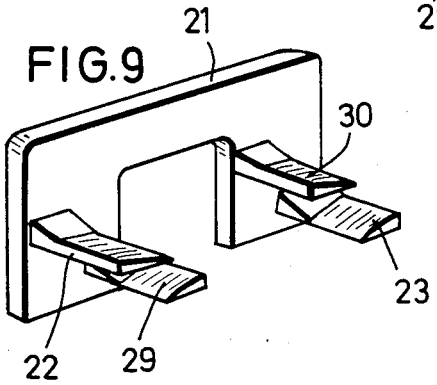
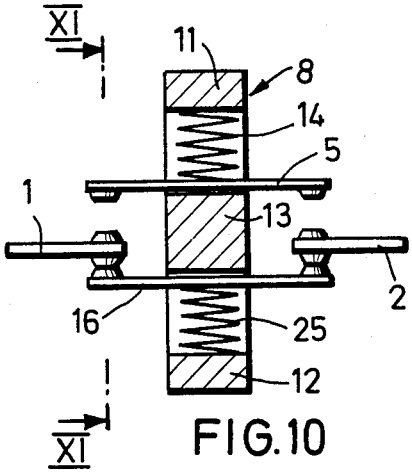
FIG.10
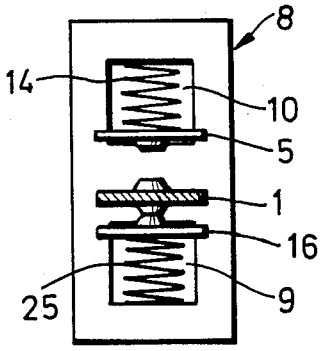
FIG.11

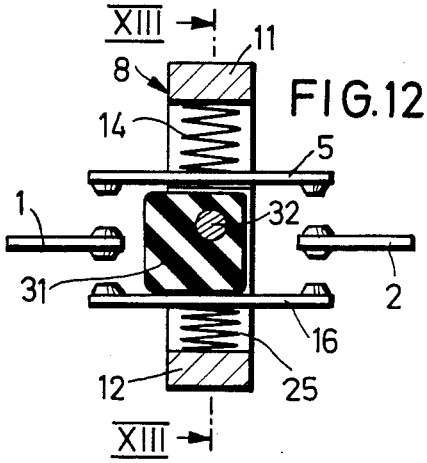
FIG.12
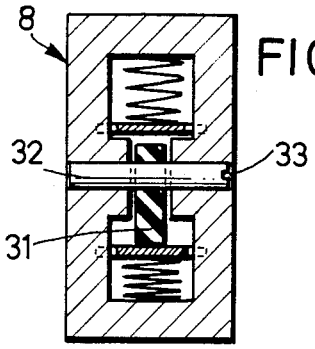
FIG.13
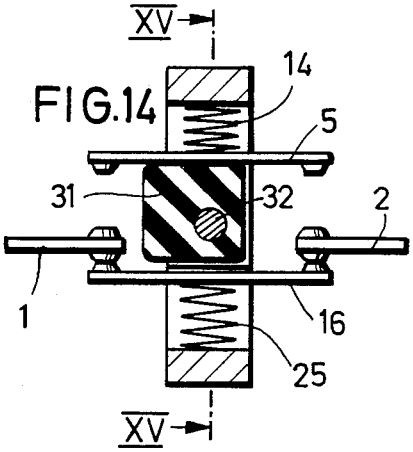
FIG.14
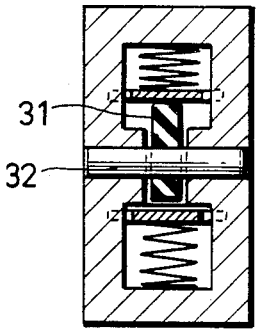
FIG.15
FIG.16
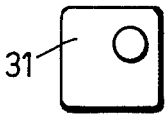
FIG.17
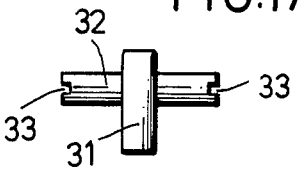

FIG. 24
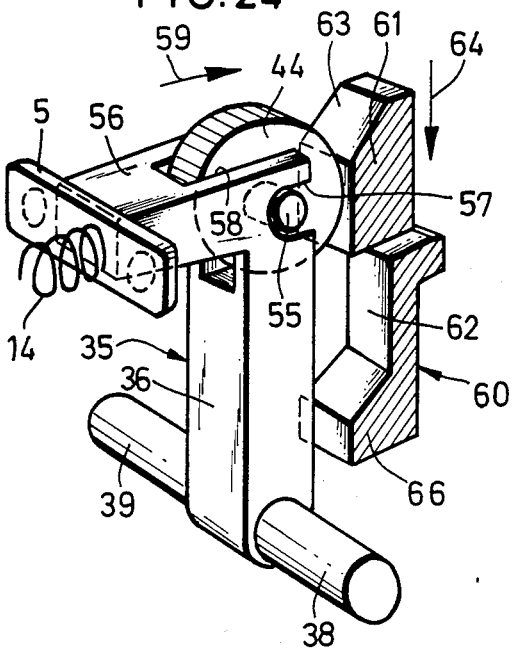
FIG. 25
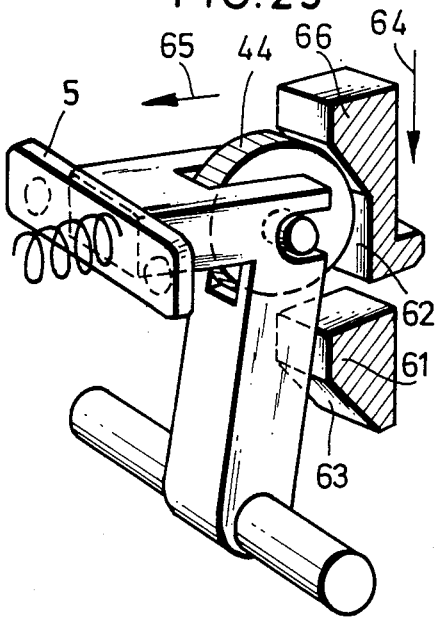
FIG. 26
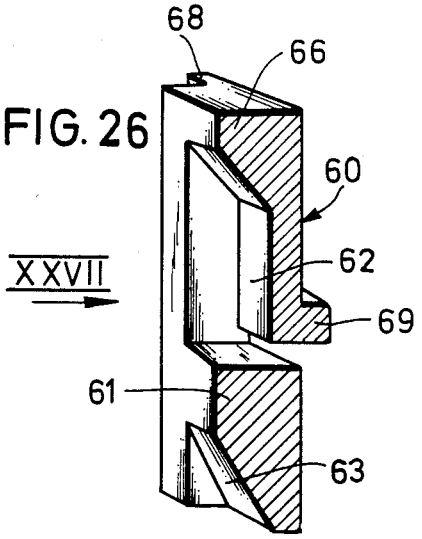
FIG. 27
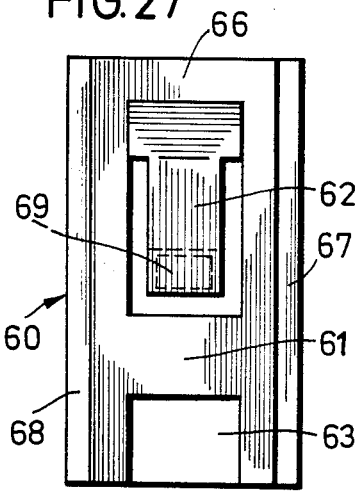
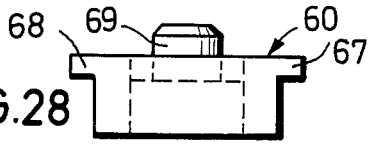
FIG. 28

CONVERTIBLE NORMALLY CLOSED/NORMALLY OPEN SWITCH WITH CAM ACTUATOR

This is a division of application Ser. No. 515,020 filed July 18, 1983.

BACKGROUND OF THE INVENTION

The invention relates in general to an electric switching device, particularly a circuit breaker, having a contact system including a movable contact bridge and at least two stationary contact parts spaced apart one from the other and cooperating with the bridge to close or open an electric circuit.

Switching devices of this kind find wide application in practice and are mass-produced. They are employed for performing a great variety of switching operations and are activated either manually or by driving mechanism or by solenoids. The switching devices of this kind contain at least one contact system of which the individual contact points are designed either as contact breakers or makers, depending upon the desired switching application. In practice it is frequently desired, for example when a large number of switching devices are needed for the construction of program control systems, that a contact breaker be converted into a contact maker, or vice versa, particularly when a change is to be made in the programmed control or if other switching tasks are desired.

In order to make such a change in the switching circuit, it has been hitherto necessary to deactivate the entire switching system and dismount the switching devices in question from a switching board or a switching panel, for example. Such disassembly requires loosening of all connection conduits whereupon the switching device is disassembled and converted from a circuit breaker into a circuit maker, or vice versa. The reinstallation proceeds in reverse order. Known are switching devices in which one or more contact bridges are installed at different levels in a bridge carrier, the levels being adjustable in dependence on whether a circuit breaker or maker is intended for a particular use. It is true that in such devices it is possible to remove a housing cover without a complete dismounting of the device from the system, and then remove the contact bridge carrier from the device, and change the level arrangement of the contact bridges according to changed conditions, and then reinstall the adjusted bridge carrier into the device. Nonetheless, all these converting operations in prior-art switching devices ae both complicated and, in any event, very time-consuming and troublesome and can be performed only by specialized service men who known the construction of the device in detail.

SUMMARY OF THE INVENTION

It is therefore a general object of the invention to provide an improved switching device of the aforedescribed type which can be easily converted from a circuit breaker into a circuit maker, or vice versa, even if installed and wired in a switching system, without the necessity of its dismounting or loosening of its wire terminals.

In keeping with these objects and others which will become apparent hereafter, one feature of the invention resides, in a switching device of the aforedescribed kind, in the provision of a selecting member which is movable between two end positions and cooperates with the contact system of the switching device in such a manner that, in one end position, it mechanically adjusts the relative position of the contacts between the contact bridge and the contact bars into a circuit breaking arrangement and, in the other end positions, mechanically adjusts the contacts of the contact system to form a circuit making arrangement.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 7 is a modification of the device of FIG. 3;

FIG. 8 is a modification of the device of FIG. 7;

FIG. 9 is a perspective view of a modified selector slide in the device of FIGS. 7 and 8;

FIG. 10 is a prior-set arrangement of a contact system having two contact bridges;

FIG. 11 is a sectional view of the prior-art device of FIG. 10, taken along the line XI—XI;

FIG. 12 is another embodiment of this invention with a contact system arranged as a circuit maker;

FIG. 13 is a sectional side view of the device of FIG. 12, taken along the line XIII—XIII;

FIG. 14 shows the device of FIG. 12 arranged as a circuit breaker;

FIG. 15 is a sectional side view of the device of FIG. 14 taken along the line XV—XV;

FIG. 16 is a front view of a center body of the selector or converter in FIGS. 12 and 14;

FIG. 17 is a side view of the converter of FIG. 16;

FIG. 24 is a perspective view of a part of another embodiment of this invention;

FIG. 25 is a perspective view of the device of FIG. 24 shown in a different working position;

FIG. 26 is a perspective view, partly in vertical section, of a detail of FIG. 25;

FIG. 27 is a side view of the part of FIG. 26, viewed in the direction of arrow XXVII;

FIG. 28 is a plan view of the part of FIG. 27.

DESCRIPTION OF THE PREFERRED EMBODIMENT

Figure 1:
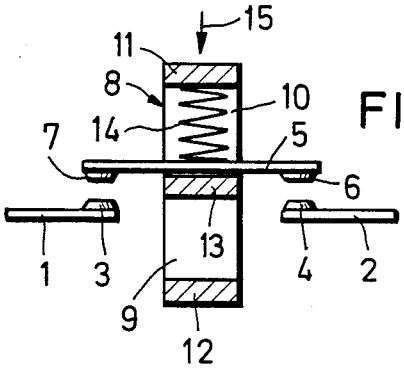
FIGS. 1 and 2 show a prior-art contact system with a contact bridge arranged as a circuit maker and a circuit breaker, respectively.
Figure 2:
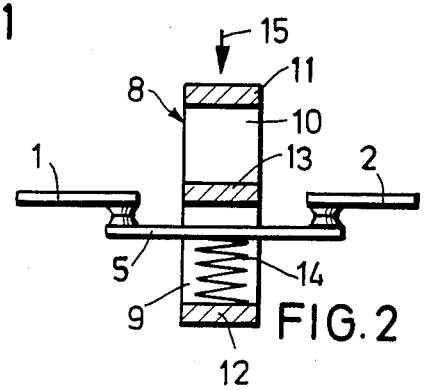

FIGS. 1 and 2 show a contact system according to the state of the art, used for example as the so-called auxiliary contact in a safety switch. The contact system has two stationary contact bars 1 and 2 provided with contact points 3 and 4, and a movable contact bridge 5 with contact points 6 and 7. The contact bridge 5 is arranged in a contact bridge carrier 8 in the form of a double frame which defines two superposed cut-outs or windows 9 and 10, outer partitions 11 and 12, and an inner partition 13. According to FIG. 1, the contact bridge 5 is inserted in the upper window 10 and in the rest position of the bridge carrier it bears upon the upper surface of the inner partition 13. A pressure spring 14 is inserted between the contact bridge 5 and the inner surface of the upper partition 11. The contact system according to FIG. 1 represents a contact maker or a normally open switch operating as follows:

The contact bridge carrier 8 is held in the depicted rest position by means of a non-illustrated spring. In the case of a safety switch, the contact bridge holder is coupled to the armature of a solenoid, whereby the armature is also held in the uppermost rest position by the non-illustrated spring. When the solenoid is energized, or when the contact bridge carrier is depressed manually via a non-illustrated pushbutton at the upper end of the carrier in the direction of arrow 15, then the contact bridge 5 is moved together with its carrier downwardly until its contact pieces 6 and 7 engage the stationary contact pieces 3 and 4. The contact bridge carrier 8 in most cases continues to move a small distance downwardly, so that the contact pieces are under the pressure of the spring 14. It is is desired to convert the circuit maker of FIG. 1 into a circuit breaker or a normally closed switch as in FIG. 2, then in this prior-art arrangement is is necessary to remove the contact bridge carrier 8 together with the contact bridge 5 from the switching device. Thereafter, the contact bars 1 and 2 must be turned around by 180°, so that the contact pieces 3 and 4 be directed downwardly. This position reversal necessitates the disconnection of wires from terminals of the contact bars 1 and 2 and the subsequent reconnection of these wires. Moreover, the contact bridge 5 and the contact spring 14 must be removed from the upper window 10 and reinserted in a reversed position in the lower window 9. In most cases, it is not possible to reverse the position of the contact bridge carrier by 180° without further precautions, inasmuch as the bridge carrier is a part of a more complicated system in which additional contact bridges are arranged side-by-side or one above the other. After the reinstallation of the contact bridge holder 8, the contacts 6 and 7 of the bridge are, in the rest position of the bridge carrier, under the load of spring 14 which presses the contacts 6 and 7 against the contact pieces 3 and 4 of the stationary bars. If the contact system in this circuit breaking arrangement is activated, then the bridge carrier 8 is moved downwardly in the direction of arrow 15 until the inner partition 13 abuts against the bridge and displaces the same downwardly, whereby the contact pieces are disconnected. From the foregoing description, it is evident that the conversion of a circuit making arrangement into a circuit breaking arrangement in the prior-art devices is a very cumbersome and time-consuming operation.

Figure 3:
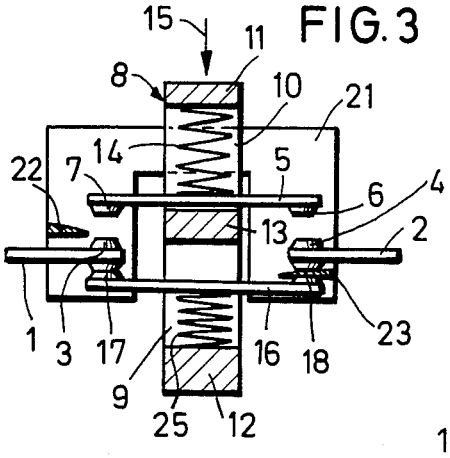
FIG. 3 shows the switching device of this invention with its contact system in the circuit breaking position.
Figure 4:
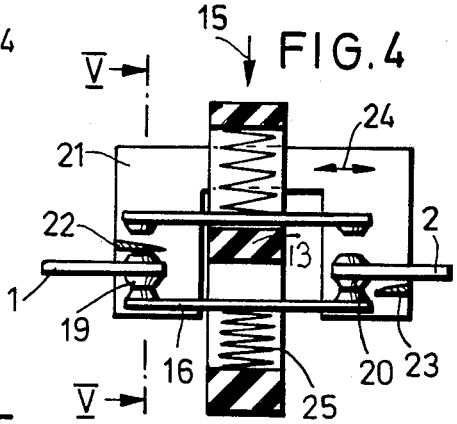
FIG. 4 is the device of FIG. 3 in its circuit making position.

Referring now to FIGS. 3–6, there is illustrated a first embodiment of a contact system according to this invention which makes it possible to convert in an extremely simple manner the circuit making arrangement of switching contacts into a circuit breaking arrangement, or vice versa. The component parts of the switching device corresponding to those described in connection with FIGS. 1 and 2 are designated with like reference characters. In this embodiment, the switching device is provided with a selector or converter in the form of a slider 21 which is movable between two end positions, transversely to the path of movement of the bridge carrier 8. One end position is illustrated in FIG. 3, and the other end position in the direction of movement indicated by arrow 24 is shown in FIG. 4. The configuration of the conversion slider is such that, in one end position thereof, it converts the contact system into a circuit maker and, in the opposite end position, into a circuit breaker. For this purpose, the carrier 8 is provided with two contact bridges 5 and 16 arranged in respective windows 9 and 10 of the carrier opposite both sides of the contact rods 1 and 2. Both contact bridges 5 and 16 are pressed by pressure springs 14 and 25 in opposite directions toward the inner partition 13. The stationary contact rods 1 and 2 have contact pieces on both sides thereof, namely the upper sides are provided with contact pieces 3 and 4, and the lower sides with contact pieces 19 and 20 which cooperate with contact pieces 17 and 18 on the second contact bridge 16. The selector slider 21 supports two wedge-shaped projections 22 and 23 of an insulating material which are oriented such that, in one end position of the slider 21 (FIG. 4), one projection 22 is situated between the upper contact bridge 5 and upper contact piece 3 of the contact bar 1 whereas the other projection 23 is out of range of the contact system. In the other end position of slider 21 (FIG. 3), the wedge-shaped projection 23 is located between the contact piece 18 of the lower bridge 16 and the lower contact piece 20 of the stationary contact bar 2, and the first-mentioned insulating projection 22 is out of range of the contact system.

The operation of the device of this invention is as follows:

In the position of the selector slider 21 depicted in FIG. 3, the right-hand insulating projection 23 interrupts the connection between contact pieces 1 and 2 and, consequently, the device acts as a contact maker. In other words, when the bridge holder 8 is moved in the direction of arrow 15, contact pieces 6 and 7 of the upper contact bridge 5 engage the upper contact pieces 3 and 4 of respective contact bars 1 and 2, and a conductive connection between the two bars is established.

In the other end position of selector slider 21, depicted in FIG. 4, the insulating projection 23 is shifted to the right out of the range of the contact system, thus permitting both contact pieces 17 and 18 of the lower bridge 16 to engage the opposite contact pieces 19 and 20 on respective contact arms 1 and 2, whereas the left-hand insulating projection 22 is displaced to the right between the contact pieces 7 and 3 of the upper bridge 5 and the contact rod 1. In this manner, the switching device is converted into a circuit breaker, namely after depression of the bridge carrier in the direction of arrow 15 the lower contact bridge 16 breaks the circuit while the insulating projection 22 prevents the closing of the circuit by the upper bridge 5.

It will be seen from the drawing that the selector slider 21 is in the form of a plate which is shiftable in the direction of arrow 24 parallel to the longitudinal direction of the bridges 5 and 16. The insulating projections 22 and 23 are perpendicular to the surface of the slider plate and are staggered relative to each other about a combined thickness of the contact bar and of the opposite contacts 3, 19 or 4, 20.

Figure 6:
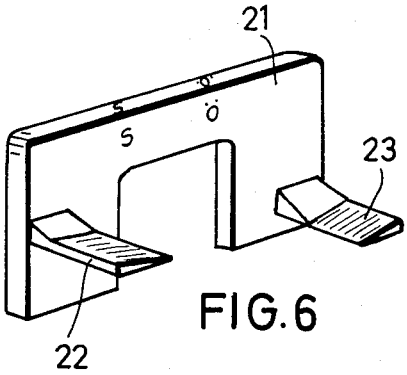
FIG. 6 is a perspective view of a selector slide in the device of FIGS. 3–5.

With advantage, the insulating projections have a wedge-shaped configuration converging in the sliding directions of the slider 21 (FIG. 6).

The sliding plate 21 preferably has a rectangular shape with longer sides which exceed in length the contact bridges 5 and 16 and the insulating projections 22 and 23 are arranged at opposite short sides of the plate. As mentioned before, each projection is arranged at a different level, so that after shifting the plate in a selected direction along the contact bridges, one of the contact bridges engages a contact piece which is diametrically opposed to the contact piece disengaged by the other projection. This construction of the selector slider 21 has the advantage that it can be additionally added to existing switching devices without the necessity of a substantial structural change. Preferably, the slider 21 is arranged for sliding movement along the inner wall of a housing 27 indicated by dash-dot lines in FIG. 5. If desired, the inner wall of the housing is provided with non-illustrated guideways and stop surfaces for delimiting the movement of the slider 21 in direction of arrow 24. It is also advantageous when the lid of the housing opposite the narrow upper side of the slider 21 is formed with an access opening 38 through which the slider 21 is visible. The access opening 28 serves also for the displacement of the slider into one of its end positions by means of a tool, for example. In a modification, the upper narrow side of the slider 21 can be provided with a control lever passing through the opening 28, so that the slider can be displaced by hand.

It is also of advantage when the slider 21 is provided with index marks, such as S or O indicated in FIG. 6, which indicate whether the contact system is switched over into its contact breaking or contact making position. The slider 21 and its projections 22 and 23 are made of insulating material which is resistant to electric arcs.

In order to ensure the slider 21 against unintentional displacement, for example due to jerking movements during transport of the device, there are provided detention means to hold the slider in its end position. The detention devices can include for example leaf springs connected to the housing for jumping into corresponding notches in the slider.

Figure 5:
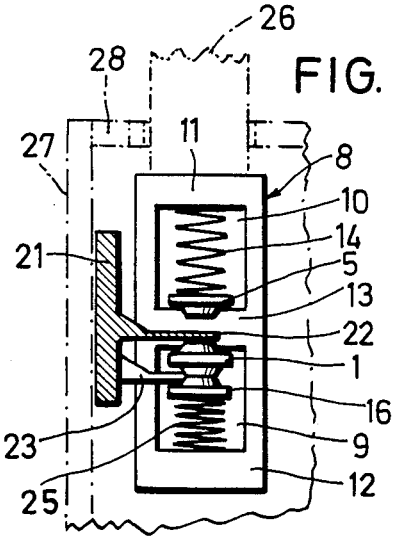
FIG. 5 is a sectional view of the device of FIG. 4 shown along the line V—V.

FIGS. 7–9 depict a modification of the device of FIGS. 3–5. In this example, slider 21 is provided with two pairs of oppositely directed wedge-shaped projections 22, 29 and 23, 30 for simultaneously engaging or disengaging the upper or lower contact pieces on respective contact bars 1 and 2. In particular, in one end position of slider 21 illustrated in FIG. 7, the lower insulating projections 23 and 29 are inserted between the lower contacts of both contact bars 1 and 2 and the corresponding contact pieces on the lower bridge 15, whereas the upper projections 22 and 30 are laterally displaced outside the path of movement of the contact system on the upper bridge 5. After actuation of the bridge carrier 8, the normally open circuit is closed, and consequently in the left side end position of the slider 21 the switching device acts as a contact maker. In the opposite end position of slider 21, the upper projections 22 and 30 engage the upper contact pieces on contact bars 1 and 2, whereas the lower contact pieces engage the lower contact bridge 16. Accordingly, after the actuation of carrier 8, the switching device acts as a contact breaker.

FIGS. 10 and 11 show a prior-art contact system which may serve for better understanding of further embodiments of this invention illustrated in FIGS. 12–17. It has already been known from prior art to provide a contact bridge carrier 8 with two contact bridges 5 and 16 at both sides of stationary contact bars 1 and 2. The bridges are spring-biased in such a manner that, after actuation of the carrier 8, the lower contact bridge 16 opens the circuit between the contact bars 1 and 2, whereupon the upper bridge 5 again closes the circuit. It is evident that this prior-art arrangement serves merely for an instantaneous and temporary interruption of the circuit and has nothing to do with the conversion of the switching device into a circuit breaker or a circuit maker.

In the embodiment of this invention illustrated in FIGS. 12–17, the conversion of the switching device from a circuit breaking arrangement into a circuit making arrangement, and vice versa, is made possible by an eccentric middle piece 31 pivotally supported between the two contact bridges 5 and 16. It will be seen from the Figures that the center piece 31 has a square cross section with rounded corners and is rotatable about an axle 32 which is diagonally offset relative to the center axis of the middle piece. Accordingly, in the angular position of the piece 31 indicated in FIG. 6 and FIG. 13, both contact bridges 5 and 16 in the rest position of the carrier 8 are remote from the opposite stationary contact pieces on contact bars 1 and 2. Only after depression of the bridge carrier 8 downwardly is the circuit closed by the upper bridge 5, and accordingly in this position of the middle piece the switching device acts as a contact maker.

In the opposite angular position of middle piece 31, as depicted in FIG. 14, the switching device is converted into a circuit breaker. The lower contact bridge 16 is held in contact with lower contact pieces of the contact bars 1 and 2, and only after depression of bridge carrier 8 is the circuit interrupted.

The conversion from the circuit making to the circuit breaking positions is made simply by rotating the middle piece 31 by 90° clockwise from the position of FIG. 12 to the position of FIG. 14. The axle 32 is inserted in a bore of the bridge carrier 8 extending approximately midway between the upper and lower end sides of the carrier. Preferably, the axle is rigidly connected to the center piece 31 and one of its end faces, which is accessible from the outside, is provided with a notch 33 for a screwdriver, by means of which the angular position of the axle, and thus of the center piece 31, is adjusted. If desired, the axle 32 can be extended in length, so as to pass through a corresponding opening in the housing of the device, and the angular adjustment can be made by hand. It will also be noted that, similarly as in the example of FIG. 5, the upper end face of the bridge carrier 8 engages a hand-operated plunger or a mechanically activated device to switch over the position of the contact system.

Figure 21:
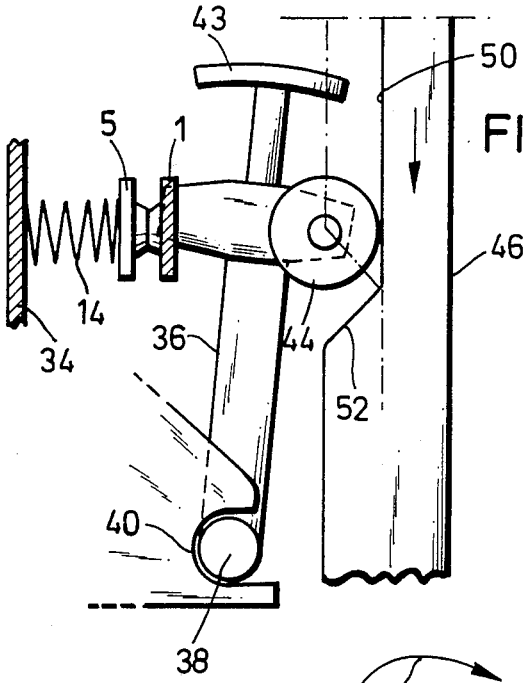
FIG. 21 is an elevational view of the device of FIG. 19, shown in another operating position.
Figure 23:
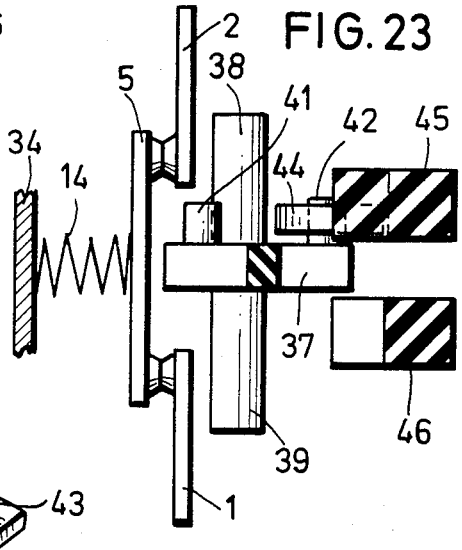
FIG. 23 is a horizontal section of the device of FIG. 20, shown in a different operating position.
Figure 22:
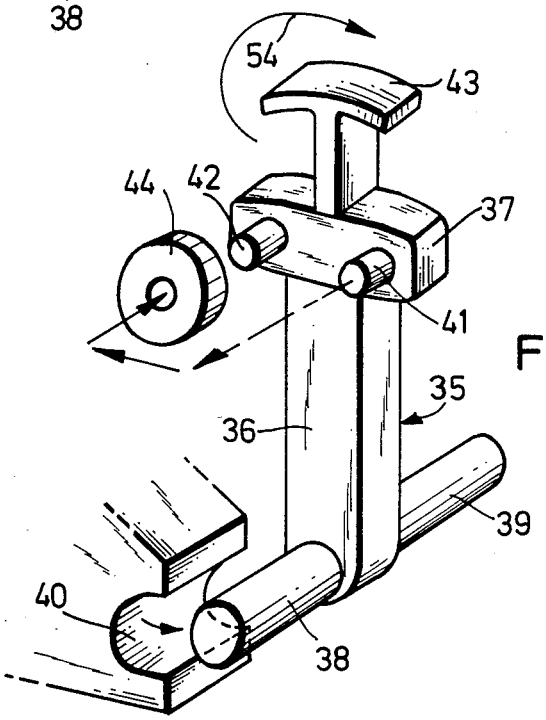
FIG. 22 is a perspective view of a part of FIG. 18.

FIGS. 18–22 illustrate still another embodiment of a contact system in the device of this invention. Similarly as in the preceding examples, there are again provided fixed contact bars 1 and 2 and a movable contact bridge which is urged by a pressure spring 14, resting on a support 34, against the contact bars. In this example, the switching device is provided with a swingably supported arm 35 which, at one side thereof, acts on the contact bridge 5 and, at the opposite side, supports a roll which follows shiftable cam tracks 45 and 46 so as to displace the contact bridge into a circuit making or a normally open position or into a circuit breaking or a normally closed position relative to contact bars 1 and 2. In this embodiment the shiftable cam tracks 45 and 46 are arranged side-by-side in the direction of their displacement. The swingable arm 35 is provided at its lower end with pivot pins 38 and 39 supported for rotation in slide bearing 40. Preferably, the bearing 40 has the shape of a semi-cylindrical groove, so that the pins 38 and 39 be easily removable. The upper end of arm 35, which in this example has the form of a lever 36 of rectangular cross section, is provided with a hammer-like extension 37 directed at one end face against the contact bridge 5 and supporting at one lateral side pivot pins 41 and 42, of which a selected one supports the cam following roller 44. In other words, the cam follower is exchangeably supported on the extension 37, so that it can be brought into engagement with the selected cam track 45 or 46. It will be seen from FIGS. 19 and 20 that the cam tracks are formed with mutually staggered recessed parts 48 and 50 and with elevated parts 47 and 49. Due to the staggered arrangement of the two cam tracks, it is possible to adjust the switching device either as a circuit breaker (a normally closed switch) as a circuit maker (a normally open switch). For example, if the roller 44 follows a cam track 46, then contact bridge 5 is moved by the action of pressure spring 14 in the direction to the contact bars 1 and 2. In other words, as soon as the cam tracks are shifted downwardly in the direction of arrow 53, the roller 44 rolls on the inclined surface 52 and reaches the recessed part 50 and, as explained before, in this position bridge 5 closes the circuit. With advantage, the swingable arm 35 is provided with a control grip 43 forming the extension of the lower part 36 of the arm and being provided with suitable inscriptions visible through a window in the housing of the switching device, so as to indicate whether the contact system is in its contact breaking or contact making position. In order to convert the contact arrangement of the device from the circuit making position illustrated in FIGS. 18–20 to a circuit breaking position, it is necessary to remove the swingable arm 35 from its bearing 40. Thereafter, as shown in FIG. 22, the cam follower roll 44 is removed from the pin 41 and inserted on the other bearing pin 42. Then, the arm 35 is turned by 180° about its longitudinal axis and reinserted into its bearing 40. In the rest position of the slidable cam tracks 45 and 46, the roller 40 now bears on the recessed part 48 of the cam track 45. When the cam tracks are depressed in the direction of arrow 51, the cam follower 44 rolls from its lower position in the recess 48 via the inclined surface 53 to the higher track part 47, whereby the arm 35 is tilted against the contact bridge 5 and opens the circuit between the contact bars 1 and 2. From the above disclosure, it is evident that, also in this embodiment, the switching device can be readily converted from the contact maker (FIGS. 18–20) into a contact breaker (FIGS. 21 and 23).

Figure 18:
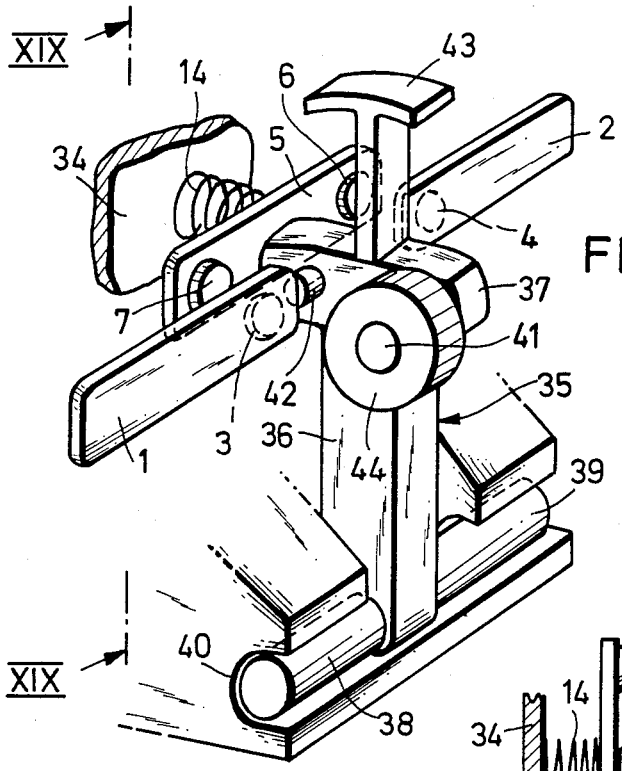
FIG. 18 is a perspective view of a part of another embodiment of the switching device of this invention.
Figure 20:
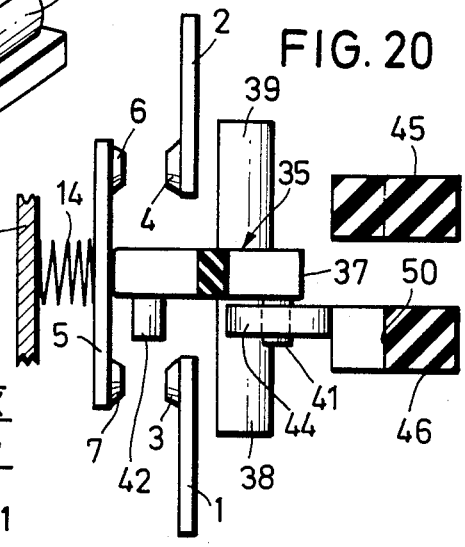
FIG. 20 is a horizontal section of the device of FIG. 19, taken along the line XX—XX.
Figure 19:
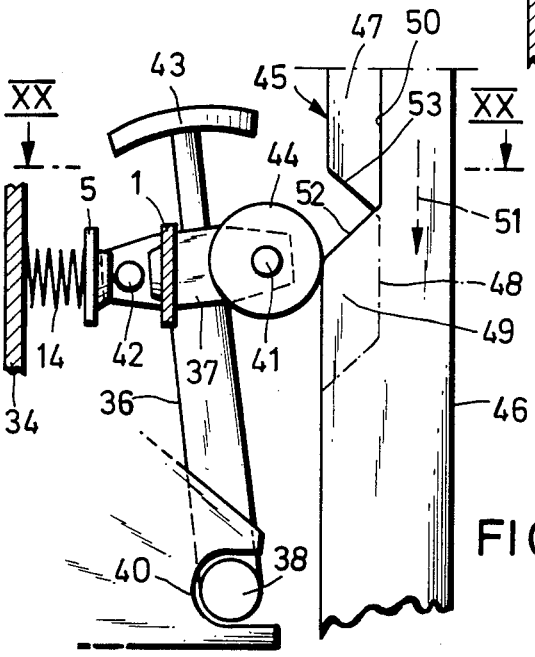
FIG. 19 is a vertical section of the device of FIG. 18, taken along the line XIX—XIX.

FIGS. 24–28 illustrate a modification of the switching device according to FIG. 18. In this embodiment, however, there are certain structural changes with respect to the embodiment of FIG. 18 which in practice enable a particularly advantageous operation. In this example, the head piece 56 projects at one side only at the free end of swinging arm 35 and cooperates with the contact bridge 5 in the same manner as in the embodiment of FIG. 18. The free end of the arm 35 has a fork-shaped configuration and is formed with a bearing 57 of a semi-cylindrical shape for receiving the axle 55 of a cam following roller 44 which is located in the fork-shaped cut-out. The actuation member in this embodiment is a slidable cam track 60 which is guided in non-illustrated guides for movement in the direction of arrow 64 and cooperates also with a non-illustrated pushbutton or other control member. The actuation member 60 is formed with an upper track part 61 followed by a recessed track part 62. The actuation member can be turned around in its guiding means by 180°, so that the recessed track part 62 is above the projecting track part 61.

When the switching device is actuated and the actuation member 60 is shifted from the position illustrated in FIG. 24 downwardly in the direction of arrow 64, the roller 44 rolls from the projecting track part 61 on the inclined surface 63, whereby the compression spring 14 moves the contact bridge 5 and the swinging arm 35 to the right in the direction of arrow 59 until the contacts on the bridge close the circuit of the non-illustrated contact bars.

When it is desired to convert the switching device from the circuit maker of FIG. 24 to a circuit breaker as depicted in FIG. 25, the actuation slider 60 is removed from its non-illustrated guides and turned around by 180° and, in this reversed position, is reinserted into its guides (FIG. 25). In the rest position of the member 60, cam follower 44 bears on the recessed track part 62. When the switching device is actuated and the member 60 is moved downwardly in the direction of arrow 64, the cam follower 44 rolls on the inclined surface to the projecting track part 66, whereby the swingable arm 35 is moved to the left in the direction of arrow 65, and the contact bridge disengages the corresponding stationary contact pieces. In this manner, the switching device operates as a contact breaker.

FIGS. 26–28 illustrate in greater detail an embodiment of the component part 60. In this example, the actuating cam track 60 has two lateral guiding ribs 67 and 68 which are insertable into corresponding guides in the housing of the switching device. The rear side of the member 60 is formed with a shoulder 69 which engages a recess in the housing of the device to hold the component part 60 in its position.

It will be understood that each of the elements described above, or two or more together, may also find a useful application in other types of constructions differing from the types described above.

While the invention has been illustrated and described as embodied in specific examples of a switching device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt if for various applications without omitting features that, from the standpoint of prior art, fairly constitute essential characteristics of the generic or specific aspects of this invention.

What is claimed as new and desired to be protected by Letters Patent is set foth in the appended claims.

I claim:

1. An electric switching device having a contact system including a movable contact bridge and two stationary contact bars cooperating with the bridge to close or open an electric circuit, comprising means for converting the device into a circuit breaker or a circuit maker, said converting means including a swingable arm which at one side thereof engages said contact bridge and at the other side is provided with a cam follower, a shiftable cam track member engaging the cam follower, means for guiding said cam track member along a straight path between a rest position and an activated position to displace via said swingable arm the contact bridge relative to said stationary contact bars, and means for adjusting the engagement between said cam follower and said cam track member so as to establish in the rest position of the latter, an open or closed switching condition of the device.

2. An electric switching device as defined in claim 1, wherein said adjusting means includes two cam tracks arranged side-by-side on said cam track member, said swingable arm being turnable by 180° about its longitudinal axis and the cam follower being displaceable from the other side to the opposite side so that in one position of the arm the cam follower engages one of the tracks which is shaped so that the switching device operates as a circuit maker, and in the other position of the arm the cam follwer engages the other track which is shaped so that the switching device operates as a circuit breaker.

3. An electric switching device having a contact system including a movable contact bridge and two stationary contact bars cooperating with the bridge to close or open an electric circuit, comprising means for converting the device into a circuit breaker or a circuit maker, said converting means including a swingable arm which at one side thereof engages said contact bridge and at the other side is provided with a cam follower, a shiftable cam track member engaging the cam follower to displace via said swingable arm the contact bridge into an open or closed switching position, the cam track member including two cam tracks arranged side-by-side, said swingable arm being turnable by 180° about its longitudinal axis and the cam follower being displaceable from the other side to the opposite side so that in one position of the arm the cam follower engages one of the tracks which is shaped so that the switching device operates as a circuit maker, and in the other position of the arm the cam follower engages the other track which is shaped so that the switching device operates as a circuit breaker, said swingable arm having a lower part provided with pivot pins and hammer shaped upper part directed toward said bridge and having at one side thereof two bearing pins spaced apart one from the other, a roller supported for rotation on the bearing pin remote from the contact bridge to act as the cam follower and being replaceable to the other bearing pin when the arm is turned around its longitudinal axis by 180°, and a housing part formed with semicylindrical bearing recesses for accommodating the pivot pins of the swingable arm and further including guiding means for the shiftable cam track member.

4. An electric switching device as defined in claim 2, wherein the swingable arm is provided with an upwardly projecting control handle.

5. An electric switching device as defined in claim 1, wherein the adjusting means includes a single cam track formed on said cam track member and being provided with raised and recessed cam surfaces arranged so that in a rest position of the cam track member the device operates as a circuit maker; and further comprising a housing formed with said guiding means, said cam track member being turnable in said guiding means through 180° so that the device in the converted rest position of the member operates as a circuit breaker.

6. An electric switching device as defined in claim 5, wherein the rear side of the cam track member is provided with a stop pin engaging a corresponding recess in the guiding means of the housing to secure the cam track member in the selected angular position.

* * * * *